US011136658B2

(12) United States Patent
Shibata et al.

(10) Patent No.: US 11,136,658 B2
(45) Date of Patent: Oct. 5, 2021

(54) HIGH STRENGTH ALUMINUM ALLOY EXTRUDED MATERIAL WITH EXCELLENT CORROSION RESISTANCE AND FAVORABLE QUENCHING PROPERTIES AND MANUFACTURING METHOD THEREFOR

(71) Applicant: AISIN KEIKINZOKU CO., LTD., Imizu (JP)

(72) Inventors: Karin Shibata, Oyabe (JP); Tomoo Yoshida, Toyama (JP)

(73) Assignee: AISIN KEIKINZOKU CO., LTD.

( * ) Notice: Subject to any disclaimer, the term of this patent is extended or adjusted under 35 U.S.C. 154(b) by 0 days.

(21) Appl. No.: 16/142,379

(22) Filed: Sep. 26, 2018

(65) Prior Publication Data

US 2019/0024224 A1 Jan. 24, 2019

Related U.S. Application Data

(63) Continuation of application No. PCT/JP2017/011145, filed on Mar. 21, 2017.

(30) Foreign Application Priority Data

Mar. 30, 2016 (JP) ..... JP2016-066950

(51) Int. Cl.
*C22F 1/053* (2006.01)
*C22C 21/10* (2006.01)
(Continued)

(52) U.S. Cl.
CPC ..... *C22F 1/053* (2013.01); *B21C 23/00* (2013.01); *B22D 11/003* (2013.01); *C22C 21/10* (2013.01); *C22F 1/002* (2013.01)

(58) Field of Classification Search
USPC ..... 148/690
See application file for complete search history.

(56) References Cited

U.S. PATENT DOCUMENTS

2007/0074791 A1 4/2007 Yoshida et al.
2011/0253266 A1* 10/2011 Bush ..... C22C 21/10 148/550
(Continued)

FOREIGN PATENT DOCUMENTS

CA 2950075 A1 12/2015
EP 1241275 A1 9/2002
(Continued)

OTHER PUBLICATIONS

Extended European Search Report for Patent Application No. EP 17774503.1, dated Aug. 27, 2019 (18 pages).
(Continued)

*Primary Examiner* — Brian D Walck
(74) *Attorney, Agent, or Firm* — Harness, Dickey & Pierce, P.L.C.

(57) ABSTRACT

An aluminum alloy extruded material that exhibits high strength by air cooling immediately after extrusion processing and excellent stress corrosion cracking resistance, and a method for manufacturing the same are disclosed. The material includes, by mass: 6.0 to 8.0% of Zn, 1.50 to 2.70% of Mg, 0.20 to 1.50% of Cu, 0.005 to 0.05% of Ti, 0.10 to 0.25% of Zr, 0.3% or less of Mn, 0.05% or less of Cr, 0.25% or less of Sr, and 0.10 to 0.50% in total among Zr, Mn, Cr and Sr, with the balance being Al and unavoidable impurities.

6 Claims, 3 Drawing Sheets

| | | ALLOY COMPONENTS (MASS %) | | | | | | | | | | Mn+Cr |
|---|---|---|---|---|---|---|---|---|---|---|---|---|
| | | Si | Fe | Cu | Mn | Mg | Cr | Zn | Zr | Sr | Ti | +Zr+Sr |
| 1 | EXAMPLE | 0.10 | 0.15 | 0.29 | 0.00 | 2.08 | 0.00 | 6.57 | 0.17 | 0.04 | 0.03 | 0.21 |
| 2 | EXAMPLE | 0.05 | 0.15 | 0.29 | 0.00 | 2.40 | 0.00 | 6.65 | 0.20 | 0.04 | 0.03 | 0.24 |
| 3 | EXAMPLE | 0.05 | 0.16 | 0.50 | 0.13 | 2.42 | 0.00 | 6.65 | 0.18 | 0.03 | 0.03 | 0.34 |
| 4 | EXAMPLE | 0.05 | 0.17 | 0.52 | 0.00 | 2.56 | 0.00 | 6.81 | 0.18 | 0.04 | 0.03 | 0.22 |
| 5 | EXAMPLE | 0.04 | 0.15 | 1.00 | 0.00 | 2.50 | 0.00 | 6.70 | 0.18 | 0.04 | 0.03 | 0.22 |
| 6 | EXAMPLE | 0.04 | 0.15 | 0.25 | 0.00 | 2.55 | 0.00 | 6.70 | 0.20 | 0.04 | 0.02 | 0.24 |
| 7 | EXAMPLE | 0.04 | 0.15 | 0.75 | 0.00 | 2.55 | 0.00 | 6.00 | 0.20 | 0.04 | 0.02 | 0.24 |
| 8 | EXAMPLE | 0.05 | 0.15 | 0.25 | 0.25 | 1.70 | 0.00 | 6.70 | 0.20 | 0.00 | 0.03 | 0.45 |
| 9 | COMPARATIVE EXAMPLE | 0.05 | 0.16 | 2.10 | 0.00 | 2.10 | 0.00 | 5.43 | 0.18 | 0.00 | 0.02 | 0.18 |
| 10 | COMPARATIVE EXAMPLE | 0.05 | 0.17 | 2.16 | 0.00 | 2.03 | 0.00 | 6.69 | 0.18 | 0.00 | 0.02 | 0.18 |
| 11 | COMPARATIVE EXAMPLE | 0.05 | 0.15 | 2.16 | 0.00 | 2.16 | 0.00 | 6.65 | 0.20 | 0.00 | 0.03 | 0.20 |
| 12 | COMPARATIVE EXAMPLE | 0.05 | 0.15 | 2.16 | 0.00 | 2.16 | 0.00 | 6.65 | 0.20 | 0.04 | 0.03 | 0.24 |
| 13 | COMPARATIVE EXAMPLE | 0.05 | 0.15 | 0.25 | 0.00 | 1.25 | 0.00 | 6.70 | 0.20 | 0.00 | 0.02 | 0.20 |
| 14 | COMPARATIVE EXAMPLE | 0.05 | 0.15 | 1.60 | 0.26 | 2.50 | 0.26 | 5.60 | 0.00 | 0.00 | 0.03 | 0.52 |
| 15 | COMPARATIVE EXAMPLE | 0.04 | 0.15 | 1.55 | 0.00 | 2.50 | 0.00 | 6.70 | 0.18 | 0.04 | 0.03 | 0.22 |

(51) Int. Cl.

| | |
|---|---|
| ***C22F 1/00*** | (2006.01) |
| ***B21C 23/00*** | (2006.01) |
| ***B22D 11/00*** | (2006.01) |

(56) References Cited

U.S. PATENT DOCUMENTS

| | | | |
|---|---|---|---|
| 2012/0234440 | A1 | 9/2012 | Miyata et al. |
| 2013/0146183 | A1 | 6/2013 | Miyata et al. |

FOREIGN PATENT DOCUMENTS

| | | | | |
|---|---|---|---|---|
| EP | 1543174 | A2 | 6/2005 | |
| EP | 2141253 | A1 | 1/2010 | |
| EP | 2386667 | A1 | 11/2011 | |
| JP | 2009-13479 | A | 1/2009 | |
| JP | 2009-114514 | A | 5/2009 | |
| JP | 2010-179363 | A | 8/2010 | |
| JP | 2014-125676 | A | 7/2014 | |
| JP | 2015-221924 | A | 12/2015 | |
| RU | 2576283 | C1 | 2/2016 | |
| WO | WO-2015169163 | A1 * | 11/2015 | ..... C22C 21/10 |

OTHER PUBLICATIONS

International Search Report received in PCT Application No. PCT/JP2017/011145 dated Jun. 13, 2017.

Tkachenko E.A. et al, "The Properties and Structure of High Strength Aluminum 1933 Alloy Forqinqs", Aluminum Alloys: Their Physical and Mechanical Properties—Proceedings ICAA5—Part 3, (Jul. 1, 1996), pp. 1819-1822, XP055748001. Copyright 1996.

ASTM, "Standard Practice for Extrusion Press Solution Heat Treatment for Aluminum alloys", ASTM Standard B807 / B807M-06, (2011), pp. 615-619, XP055748021.

"Aluminum-Zinc-Magnesium Alloys", L. F. Mondolfo, Aluminum Alloys: Structure and Properties, 1976, Butterworth & Co, pp. 844-865, XP005574802. Published in 1976.

Anonymous, "International Alloy Designations and Chemical Composition Limits for Wrought Aluminum and Wrought Aluminum Alloys", Aluminum Association, (20150100), URL: https://www.aluminum.org/sites/default/files/Teal%20Sheets.pdf, XP055748004. Dated Feb. 2009 (supersedes) and Jan. 2015 (revised). 38 pages.

* cited by examiner

FIG. 1

| | | ALLOY COMPONENTS (MASS %) | | | | | | | | | | Mn+Cr +Zr+Sr |
|---|---|---|---|---|---|---|---|---|---|---|---|---|
| | | Si | Fe | Cu | Mn | Mg | Cr | Zn | Zr | Sr | Ti | |
| 1 | EXAMPLE | 0.10 | 0.15 | 0.29 | 0.00 | 2.08 | 0.00 | 6.57 | 0.17 | 0.04 | 0.03 | 0.21 |
| 2 | EXAMPLE | 0.05 | 0.15 | 0.29 | 0.00 | 2.40 | 0.00 | 6.65 | 0.20 | 0.04 | 0.03 | 0.24 |
| 3 | EXAMPLE | 0.05 | 0.16 | 0.50 | 0.13 | 2.42 | 0.00 | 6.65 | 0.18 | 0.03 | 0.03 | 0.34 |
| 4 | EXAMPLE | 0.05 | 0.17 | 0.52 | 0.00 | 2.56 | 0.00 | 6.81 | 0.18 | 0.04 | 0.03 | 0.22 |
| 5 | EXAMPLE | 0.04 | 0.15 | 1.00 | 0.00 | 2.50 | 0.00 | 6.70 | 0.18 | 0.04 | 0.03 | 0.22 |
| 6 | EXAMPLE | 0.04 | 0.15 | 0.25 | 0.00 | 2.55 | 0.00 | 6.70 | 0.20 | 0.04 | 0.02 | 0.24 |
| 7 | EXAMPLE | 0.04 | 0.15 | 0.75 | 0.00 | 2.55 | 0.00 | 6.00 | 0.20 | 0.04 | 0.02 | 0.24 |
| 8 | EXAMPLE | 0.05 | 0.15 | 0.25 | 0.25 | 1.70 | 0.00 | 6.70 | 0.20 | 0.00 | 0.03 | 0.45 |
| 9 | COMPARATIVE EXAMPLE | 0.05 | 0.16 | 2.10 | 0.00 | 2.10 | 0.00 | 5.43 | 0.18 | 0.00 | 0.02 | 0.18 |
| 10 | COMPARATIVE EXAMPLE | 0.05 | 0.17 | 2.16 | 0.00 | 2.03 | 0.00 | 6.69 | 0.18 | 0.00 | 0.02 | 0.18 |
| 11 | COMPARATIVE EXAMPLE | 0.05 | 0.15 | 2.16 | 0.00 | 2.16 | 0.00 | 6.65 | 0.20 | 0.00 | 0.03 | 0.20 |
| 12 | COMPARATIVE EXAMPLE | 0.05 | 0.15 | 2.16 | 0.00 | 2.16 | 0.00 | 6.65 | 0.20 | 0.04 | 0.03 | 0.24 |
| 13 | COMPARATIVE EXAMPLE | 0.05 | 0.15 | 0.25 | 0.00 | 1.25 | 0.00 | 6.70 | 0.20 | 0.00 | 0.02 | 0.20 |
| 14 | COMPARATIVE EXAMPLE | 0.05 | 0.15 | 1.60 | 0.26 | 2.50 | 0.26 | 5.60 | 0.00 | 0.00 | 0.03 | 0.52 |
| 15 | COMPARATIVE EXAMPLE | 0.04 | 0.15 | 1.55 | 0.00 | 2.50 | 0.00 | 6.70 | 0.18 | 0.04 | 0.03 | 0.22 |

FIG. 2

| MANUFACTURING CONDITIONS | | CASTING RATE | HOMO TEMPERATURE | AVERAGE CRYSTALIZED GRAIN DIAMETER IN BILLET | BLT TEMPERATURE | COOLING RATE | HEAT TREATMENT CONDITIONS | |
|---|---|---|---|---|---|---|---|---|
| | | | | | | | FIRST STAGE | SECOND STAGE |
| | | 65 MM/MIN OR MORE | 480～520℃ | 250 μm OR LESS | 400℃ OR MORE | 450℃ /MIN OR LESS | 90～120℃ | 130～180℃ |
| 1 | EXAMPLE | 70 | 500℃ | 150 | 430 | 280 | 110℃ | 140℃ |
| 2 | EXAMPLE | 70 | 500℃ | 125 | 430 | 280 | 110℃ | 140℃ |
| 3 | EXAMPLE | 70 | 500℃ | 150 | 430 | 280 | 110℃ | 140℃ |
| 4 | EXAMPLE | 70 | 500℃ | 120 | 430 | 280 | 110℃ | 140℃ |
| 5 | EXAMPLE | 70 | 500℃ | 120 | 430 | 280 | 110℃ | 140℃ |
| 6 | EXAMPLE | 70 | 500℃ | 110 | 430 | 280 | 110℃ | 140℃ |
| 7 | EXAMPLE | 70 | 500℃ | 110 | 430 | 280 | 110℃ | 140℃ |
| 8 | EXAMPLE | 80 | 500℃ | 200 | 430 | 140 | 105℃ | 135℃ |
| 9 | COMPARATIVE EXAMPLE | 70 | 500℃ | 250 | 430 | 280 | 90℃ | 160℃ |
| 10 | COMPARATIVE EXAMPLE | 70 | 500℃ | 250 | 430 | 280 | 90℃ | 160℃ |
| 11 | COMPARATIVE EXAMPLE | 70 | 500℃ | 250 | 430 | 280 | 120℃ | 160℃ |
| 12 | COMPARATIVE EXAMPLE | 70 | 500℃ | 200 | 430 | 280 | 120℃ | 160℃ |
| 13 | COMPARATIVE EXAMPLE | 85 | 520℃ | 200 | 430 | 80 | 90℃ | 140℃ |
| 14 | COMPARATIVE EXAMPLE | 60 | 480℃ | 300 | 430 | 280 | 90℃ | 140℃ |
| 15 | COMPARATIVE EXAMPLE | 70 | 500℃ | 150 | 430 | 280 | 110℃ | 140℃ |

FIG. 3

| EVALUATION | | T5 TENSION STRENGTH [Mpa] | T5 PROOF STRESS [Mpa] | T5 EXTENSION [%] | SCC PROPERTY | MICROSTRUCTURE | OVERALL JUDGMENT |
|---|---|---|---|---|---|---|---|
| | | | | | | SURFACE RECRYSTALLIZATION DEPTH | |
| | | 480 MPa OR MORE | 460 MPa OR MORE | 10% OR MORE | 720 CYCLES OR MORE | 150 μm OR LESS | |
| 1 | EXAMPLE | 568 | 530 | 12.0 | 720 OR MORE | 50 | ○ |
| 2 | EXAMPLE | 593 | 550 | 14.0 | 720 OR MORE | 50 | ○ |
| 3 | EXAMPLE | 588 | 550 | 13.0 | 720 OR MORE | 50 | ○ |
| 4 | EXAMPLE | 618 | 580 | 12.5 | 720 OR MORE | 50 | ○ |
| 5 | EXAMPLE | 625 | 585 | 13.0 | 720 | 20 | ○ |
| 6 | EXAMPLE | 630 | 587 | 12.5 | 720 | 20 | ○ |
| 7 | EXAMPLE | 633 | 589 | 13.0 | 720 | 20 | ○ |
| 8 | EXAMPLE | 532 | 502 | 13.0 | 720 OR MORE | 50 | ○ |
| 9 | COMPARATIVE EXAMPLE | 547 | 472 | 14.4 | 240 | 20 | × |
| 10 | COMPARATIVE EXAMPLE | 580 | 530 | 13.6 | 240 | 20 | × |
| 11 | COMPARATIVE EXAMPLE | 576 | 526 | 13.0 | 240 | 220 | × |
| 12 | COMPARATIVE EXAMPLE | 591 | 544 | 11.0 | 240 | 100 | × |
| 13 | COMPARATIVE EXAMPLE | 460 | 422 | 14.0 | 720 OR MORE | 50 | × |
| 14 | COMPARATIVE EXAMPLE | 517 | 446 | 14.0 | 240 | 200 | × |
| 15 | COMPARATIVE EXAMPLE | 590 | 545 | 13.0 | 240 | 200 | × |

HIGH STRENGTH ALUMINUM ALLOY EXTRUDED MATERIAL WITH EXCELLENT CORROSION RESISTANCE AND FAVORABLE QUENCHING PROPERTIES AND MANUFACTURING METHOD THEREFOR

CROSS REFERENCE TO RELATED APPLICATION

This application is a continuation of International Patent Application No. PCT/JP2017/011145, having an international filing date of Mar. 21, 2017, which designated the United States, the entirety of which is incorporated herein by reference. Japanese Patent Application No. 2016-066950 filed on Mar. 30, 2016 is also incorporated herein by reference in its entirety.

BACKGROUND

The present invention relates to an improved material of 7000-series Al—Zn—Mg based aluminum alloys.

Among high-strength aluminum alloys, 7000-series aluminum alloys have been drawing attentions to achieve weight reduction as a way to increase fuel economy in vehicles.

An extruded material of a 7000-series aluminum alloy for use as a structural member in vehicles is required to exhibit not only high strength but also bending workability and stress corrosion cracking resistance.

An increased addition amount of Mg, Zn, and Cu improves strength in 7000-series aluminum alloy, but significantly decreases extrudability. Increase of $MgZn_2$ precipitation also occurs and causes decrease in stress corrosion cracking resistance.

In addition, during extrusion processing, recrystallized grains on the surface of the extruded material becomes coarsened and recrystallization extends to a deeper depth. This causes decrease in stress corrosion cracking resistance.

Accordingly, transition elements such as Cr, Mn, and Zr are added, however, large amounts of addition affect quench sensitivity. To achieve a predetermined high strength, the extruded material must be subjected to rapid quenching by water cooling during die end quenching immediately after extrusion processing.

The die end quenching by water cooling causes cooling strain that causes warp or deformation of cross section in the extruded material.

An Al—Zn—Mg—Cu alloy disclosed in JP-A-2009-114514 (Japanese Patent No. 5083816) has relatively large amounts of Cu and Mg, and only extruded into a thick, simple shape, such as a sheet 6 mm thick and a pipe 7.5 mm thick, as disclosed in the above patent document. The extruded material must also be subjected to rolling or drawing to achieve high strength.

SUMMARY

An object of the invention is to provide an aluminum alloy extruded material that exhibits high strength by air-cooling immediately after extrusion processing and excellent stress corrosion cracking resistance, and a method for manufacturing the same.

According to one aspect of the invention, there is provided a high-strength aluminum alloy extruded material having excellent corrosion resistance and favorable quenching properties, comprising, by mass:

6.0 to 8.0% of Zn, 1.50 to 2.70% of Mg, 0.20 to 1.50% of Cu, 0.005 to 0.05% of Ti, 0.10 to 0.25% of Zr, 0.3% or less of Mn, 0.05% or less of Cr, 0.25% or less of Sr, and 0.10 to 0.50% in total among Zr, Mn, Cr and Sr, with the balance being Al and unavoidable impurities.

An extruded material of a high-strength aluminum alloy according to the present invention defined in claim 1 includes aspects as below:

In the aluminum alloy extruded material, Cr may not be included and a total amount of Zr, Mn, and Sr may fall within a range of 0.10 to 0.50%.

In the aluminum alloy extruded material, Cr and Sr may not be included and a total amount of Zr and Mn may fall within a range of 0.10 to 0.50%.

In the aluminum alloy extruded material, Cr and Mn may not be included and a total amount of Zr and Sr may fall within a range of 0.10 to 0.50%.

The extruded materials of a high-strength aluminum alloy described above each further includes aspects as below:

In the aluminum alloy extruded material, the amount of Cu may fall within a range of more than 0.4% and less than 0.8%.

In the above aluminum alloy extruded material, the amount of Zn may fall within a range of more than 6.5% and less than or equal to 8.0%.

In the first aspect of the invention, a recrystallization depth on a surface of the extruded material may be 150 μm or less.

The high-strength aluminum alloy extruded material according to the first aspect of the invention may have a tensile strength of 480 MPa or more and a 0.2% proof stress of 450 MPa or more.

In a method for manufacturing the high-strength aluminum alloy extruded material according to the first aspect of the invention, the method may comprise:

extruding a cast billet having an average crystalized grain diameter of 250 μm or less;

cooling the extruded material at an average cooling rate of 450° C./min or less immediately after the extrusion processing; and subjecting the extruded material to artificial aging treatment.

The component range of the aluminum alloy is selected for the following reasons.

<Zn>

Since Zn in relatively high concentrations causes little degradation in extrudability, the addition amount of Zn is preferably 6.0% or more by mass to achieve high strength.

An addition exceeding 8.0%, however, decreases stress corrosion cracking resistance.

Thus, the addition amount of Zn preferably falls within a range of 6.0 to 8.0%.

To keep Mg at relatively small concentration, the addition amount of Zn is preferably more than 6.5% and less than or equal to 8.0%.

<Mg>

Mg is most effective in achieving high strength.

Thus, the addition amount of Mg preferably falls within a range of 1.50 to 2.70%.

An addition exceeding 2.70% decreases extrudability.

Further, the addition amount of Mg is preferably 1.7% at the lowest and 2.70% at the highest to ensure a tensile strength of 530 MPa or more and a 0.2% proof stress of 500 MPa or more.

<Cu>

Cu contributes to an improvement in strength by solid solution effect. An excess addition, however, decreases extrudability and corrosion resistance.

Thus, the addition amount of Cu preferably falls within a range of 0.20 to 1.50%.

In view of preventing decrease of corrosion resistance, the addition amount of Cu preferably falls within a range of 0.20 to 1.0%. To ensure a 0.2% proof stress of 530 MPa or more, the addition amount of Cu may be set within a range of more than 0.40% and less than 0.8%.

<Zr, Mn, Cr, and Sr>

Zr, Mn, and Cr have an effect to suppress the depth (thickness) of a recrystallized layer formed on the surface of the extruded material during extrusion processing.

Among the above three components, the effect of Cr on the quench sensitivity during extrusion processing is the largest, while that of Mn is the second largest, therefore cooling immediately after extrusion at a rapid rate is required to achieve high strength.

The effect of Zr on quench sensitivity is the smallest among the three components, and a sufficiently high strength is achieved through fan air cooling as die end quenching immediately after extrusion.

Accordingly, in the present invention, the addition amount of Zr is 0.10 to 0.25%, since Zr is difficult to be dissolved in a molten aluminum alloy to an amount exceeding 0.25%.

For the above reasons, Cr is preferably not added. If Cr is added, the addition amount of Cr is preferably limited to 0.05% or less.

Also, Mn is preferably not added. If Mn is added, the addition amount of Mn is preferably limited to 0.3% or less.

Sr has an effect to prevent coarsening of crystalized grains in a texture of a billet during casting, and also prevents formation of a recrystallized layer on the surface of the billet after extrusion processing.

A larger addition amount of Sr, however, causes coarse crystallized products that have Sr as a nucleus to be easily crystallized. If Sr is added, the addition amount of Sr is 0.25% or less.

One aspect of the invention is characterized in that a total amount of Zr, Mn, Cr and Sr is set in a range of 0.10 to 0.50% to achieve both high strength and reduced thickness (depth) of a recrystallized layer on the surface.

If Cr is not contained, the total amount of Zr, Mn, and Sr falls within a range of 0.10 to 0.50%

If Cr and Sr are not contained, the total amount of Zr and Mn falls within a range of 0.10 to 0.50%.

If Cr and Mn are not included, the total amounts of Zr and Sr falls within a range of 0.10 to 0.50%

<Ti>

Ti is effective in making crystalized grains finer during casting of a billet. Ti is preferably added within a range of 0.005 to 0.05%.

<Fe, and Si>

Fe and Si are easily mixed as impurities during preparing a molten aluminum alloy and casting a billet. A large amount of addition may cause decrease in properties such as strength. Thus, the addition amount of Fe is limited to 0.2% or less and that of Si is limited to 0.01% or less.

Next, a manufacturing condition will be described.

First, for manufacturing, a columnar billet for extrusion processing needs to be cast.

A recrystallized layer is formed on the surface of the extruded material during extrusion processing. By keeping crystalized grain diameters small in the cast texture of the billet, the depth of the recrystallized layer becomes thinner.

In addition to the effect of Sr and Ti addition as components of the aluminum alloy, a casting rate also has an influence on the billet.

The casting rate of the columnar billet may be set to 50 mm/min or more, preferably 65 mm/min or more.

The cast billet is subjected to homogenization treatment at a homogenization treatment (homo) temperature of 470 to 530° C., preferably 480 to 520° C., for two to 24 hours.

The homogenized billet is then pre-heated to a temperature of 400 to 480° C. and extruded by an extrusion press machine.

Fan air cooling is performed immediately after the extrusion processing at an average cooling rate of 450° C./min or less (die end quenching by fan air cooling).

The average cooling rate preferably falls within a range of 100 to 450° C./min.

The average cooling rate more preferably falls within a range of 250 to 450° C./min.

Next, a first-stage aging is performed at a temperature of 90 to 120° C. for one to 24 hours followed by a second-stage aging at a temperature of 130 to 180° C. for one to 24 hours.

That is, a so-called two-stage artificial aging is performed.

An extruded material of an aluminum alloy according to the present invention has a high strength by setting the addition amounts of Zn, Mg, and Cu, good quenching properties by preparing a trace amount of components such as Zr, Mn, Cr, and Sr, and a recrystallized layer with reduced thickness on the surface of the extruded material.

The extruded material of an aluminum alloy having high-strength, excellent corrosion resistance, and good quenching properties is thus obtained.

BRIEF DESCRIPTION OF DRAWINGS

FIG. 1 illustrates the composition of each aluminum alloy used for evaluation.

FIG. 2 illustrates manufacturing conditions of billets and extruded materials.

FIG. 3 illustrates the evaluation results for each extruded material.

DESCRIPTION OF EXEMPLARY EMBODIMENTS

A molten aluminum alloy with alloy components listed in the table of FIG. 1 was prepared to be cast into a columnar billet at a casting rate listed in the table of FIG. 2.

In the table of FIG. 2, the homo temperature indicates homogenizing conditions of the billet. Samples were cut from the surface of the billets. The surfaces of the samples were mirror-polished and then etched by Keller's reagent (0.5% HF). Average crystalized grain diameters of the cast billets were observed by an optical microscope.

The average crystalized grain diameters each was measured by subjecting a 100× microscope image to image-processing.

The billet was pre-heated at a BLT temperature shown in the table of FIG. 2 and extruded into an extruded material having a U-shaped or channel cross section and 3 to 4 mm in thickness.

Immediately after extrusion, the extruded material was air cooled (fan air cooled) at the cooling rate shown in the table of FIG. 2, and then was subjected to two-stage artificial aging treatment under the heat treatment conditions shown in the table of FIG. 2.

The evaluation results are shown in the table of FIG. 3.

Each item was evaluated as described below.

No. 5 tension test pieces were prepared from the extruded material in accordance with Japanese Industrial Standard JIS-Z2241, and T5 tensile strength (MPa), T5 proof stress (0.2%, MPa), and T5 extension (%) were measured using a tension tester that conforms to the JIS standard.

Under a stress of 80% relative to the proof stress, the test pieces were subjected to 720 cycles of a process described later to examine SCC resistance (stress corrosion cracking resistance). The test pieces without cracks were regarded to attain the target. For the test pieces cracked in a smaller number than 720 cycles, the number of cycles in which crack occurred were counted.

<Test Conditions For One Cycle>

The test pieces were immersed with a water solution of 3.5% NaCl at 25° C. for 10 minutes, then left at 25° C. and a humidity of 40% for 50 minutes, and then let dry naturally.

The surface of the extruded material was mirror-polished and etched in a water solution of 3% NaOH. Then, the average thickness of the recrystallized layer on the surface of the extruded material was measured as a recrystallization depth with a 100× optical microscope image.

The evaluation results of FIG. 3 show that the extruded materials of aluminum alloys in examples 1 to 8 attained all the targets of tensile strength of 480 MPa or more, a 0.2% proof stress of 450 MPa or more, extension of 10% or more, and SCC resistance of 720 cycles or more.

The proof stress is preferably 460 MPa or more.

The examples 1 to 8 were free of Cr. Further, the examples 1, 2, and 7 were free of Mn.

The example 8 was free of Sr.

The examples 3, 4, 5 and 7, which contained Cu of more than 0.4%, exhibited relatively high values in tensile and proof strengths.

Comparative examples 9 to 12, 14, and 15 did not reach the target of SCC resistance.

This may be because the amount of Cu exceeds 1.50%.

For the comparative example 13, cooling rate after extrusion processing was low and the strength was insufficient.

The comparative example 14 contained 0.26% Cr.

The aluminum alloy extruded material according to the invention exhibits high strength and excellent corrosion resistance, and thus may be used as structural members for vehicles and industrial machines.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. An aluminum alloy extruded material, comprising by mass:

6.0 to 6.81% of Zn, 2.40 to 2.70% of Mg, 0.20 to 1.50% of Cu, 0.005 to 0.05% of Ti, and 0.10 to 0.25% of Zr, 0.3% or less of Mn, 0.05% or less of Cr, 0.03 to 0.25% of Sr, and 0.22 to 0.50% in total among Zr, Mn, Cr and Sr, with the balance being Al and unavoidable impurities, wherein the aluminum alloy extruded material exhibits a stress corrosion cracking resistance in which, under a stress of 80% of the proof stress, no crack occurs in test pieces which are subjected to 720 cycles, in each cycle of which the test pieces are immersed in a water solution of 3.5% NaCl at 25° C. for 10 minutes, then left at 25° C. and a humidity of 40% for 50 minutes, and then let dry naturally.

2. The aluminum alloy extruded material as defined in claim 1, wherein Cr not being included therein and a total amount of Zr, Mn, and Sr is within a range of 0.22 to 0.50%.

3. The aluminum alloy extruded material as defined in claim 1, wherein Cr and Mn are not included and a total amount of Zr and Sr is within a range of 0.22 to 0.50%.

4. The aluminum alloy extruded material as defined in claim 1, wherein the amount of Cu is within a range of more than 0.4% to less than 0.8%.

5. The aluminum alloy extruded material as defined in claim 1, wherein a recrystallization depth on a surface of the extruded material is 150 μm or less.

6. The aluminum alloy extruded material as defined in claim 1, wherein the extruded material has a tensile strength of 480 MPa or more and a 0.2% proof stress of 450 MPa or more.

* * * * *